United States Patent [19]

Sugarman

[11] Patent Number: 4,843,644

[45] Date of Patent: Jul. 4, 1989

[54] NECKTIE WITH SOIL PREVENTION MEANS

[76] Inventor: April Sugarman, 628 Michelline La., Northbrook, Ill. 60062

[21] Appl. No.: 200,233

[22] Filed: May 31, 1988

[51] Int. Cl.[4] ..... A41D 27/12; A41B 25/00

[52] U.S. Cl. ..... 2/46; 2/144; 2/49 R

[58] Field of Search ..... 2/144, 46, 49 R, 147, 2/150, 153

[56] References Cited

U.S. PATENT DOCUMENTS 3,763,496 10/1973 Miller ..... 2/46

FOREIGN PATENT DOCUMENTS 1218237 5/1960 France ..... 2/144

226911 8/1943 Switzerland ..... 2/144

*Primary Examiner*—Ronald Feldbaum

*Attorney, Agent, or Firm*—Gerstman & Ellis, Ltd.

[57] ABSTRACT

A system is disclosed for preventing a tie from becoming soiled. The necktie has a front ply and a rear ply with the rear ply defining an opening. A bib is attached to the inside of the necktie and is folded and positioned within the opening between the front ply and the rear ply. The bib defines a slot which enables a portion of the necktie to pass through the slot when the bib is unfolded and removed via the opening from between the front ply and the rear ply. In this manner, the bib will overlie the necktie portion that is passed through the slot.

5 Claims, 1 Drawing Sheet

NECKTIE WITH SOIL PREVENTION MEANS

FIELD OF THE INVENTION

The present invention concerens a novel system for preventing a necktie from becoming soiled.

BACKGROUND OF THE INVENTION

Wearing a necktie while eating can become an unpleasant experience if the necktie becomes soiled. In U.S. Pat. No. 3,763,496, a tie bar is disclosed in which a "window shade" type member may be pulled down from the tie bar to cover the necktie during eating. The disadvantage of that invention, however, is that it reques the obtaining of the tie bar in addition to the necktie and it requires that the tie bar be either attached to the necktie while the necktie is being worn or that the tie bar be carried by the wearer of the necktie for use of the tie bar during eating.

I have discovered a system for preventing a necktie from becoming soiled, which does not require the obtaining of a device that is separate from the necktie. It is an object of my invention to provide a necktie soiling prevention system that is simple in construction and relatively easy to use.

SUMMARY OF THE INVENTION

In accordance with the present invention, a necktie is provided comprising a folded member having a front ply and a rear ply. The rear ply defines an opening. An attached bib is adapted to be folded and positioned within the opening between the front ply and the rear ply. The bib defines a slot that is at least as wide as the width of the necktie for enabling a portion of the necktie to pass through the slot when the bib is unfolded and removed via the opening from between the front ply and the rear ply.

In the illustrative embodiment, a zipper is provided for closing the opening when the bib is folded and within the opening.

The method of the present invention includes the steps of providing a necktie having a front ply and a rear ply, with the rear ply defining an opening. A foldable bib is attached to the necktie, with the bib defining a slot therein. The bib is positioned within the opening between the front ply and the rear ply. The method of the present invention includes the step of unfolding the bib and removing it via the opening from between the front ply and the rear ply, and thereafter extending a portion of the necktie through the bib slot so that the bib overlies the necktie portion.

A more detailed explanation of the invention is provided in the following description and claims, and is illustrated in the accompanying drawings.

DETAILED DESCRIPTION OF THE ILLUSTRATIVE EMBODIMENT

Figure 1:
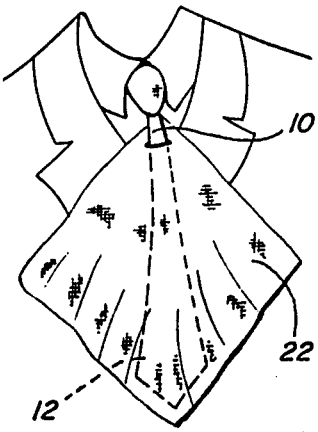
FIG. 1 is a view of the necktie system of the present invention, with the bib unfolded and in use, with a portion shown in dashed line for clarity.

Referring to the Figures, a necktie 10 is shown therein. The necktie is formed of suitable necktie material, such as silk or polyester. The necktie 10 is formed of a front ply 12 and a rear ply 14, preferably with plies 12 and 14 formed as a single folded member, with it being understood that rear ply 14 could be formed of two overlapping members in the conventional manner of forming a conventional necktie.

Rear ply 14 of necktie 10 defines an opening 16 bearing zipper tracks 18*a* and 18*b* on opposite sides thereof. A zipper 20 is provided for enabling closure of opening 16 when desired.

A foldable bib 22 is attached at one end 24 thereof to the front ply 12 via suitable attaching means 26. Bib 22 may be formed of any material that is suitable for covering the necktie and preventing the necktie from becoming soiled. For example, bib 22 may be formed of a polyester material, or other plastic material, or it may be formed of a natural material such as cotton, if desired. Bib 22 is preferably long enough to cover a substantial portion of the necktie as illustrated.

Bib 22 defines a slot 28 that has a width that is at least but preferably wider than a width of necktie 10. In this manner, when bib 22 is unfolded and removed via the opening from the tie, a portion of necktie 10 may be inserted through slot 28 so that bib 22 will overlie the tie portion that has been inserted through slot 28.

Figure 2:
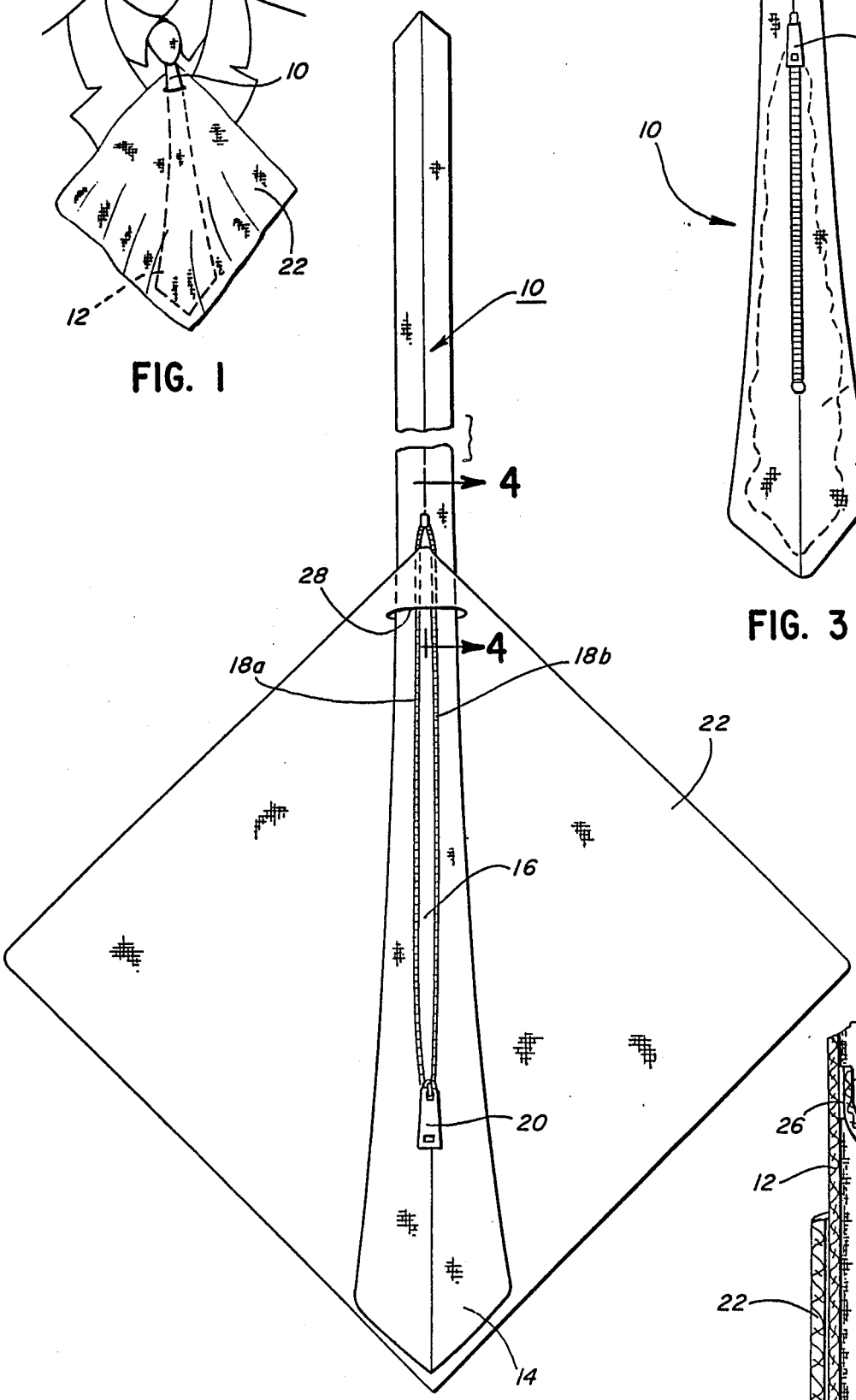
FIG. 2 is a rear view of the necktie system of the present invention, with the bib unfolded and positioned for use during eating.
Figure 3:
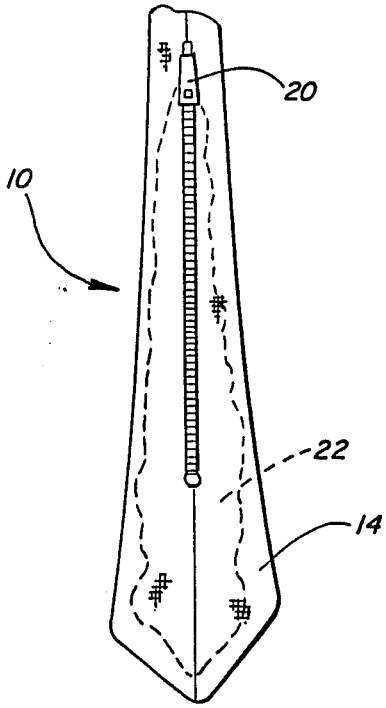
FIG. 3 is a rear view of a portion of the necktie system of the present invention.
Figure 4:
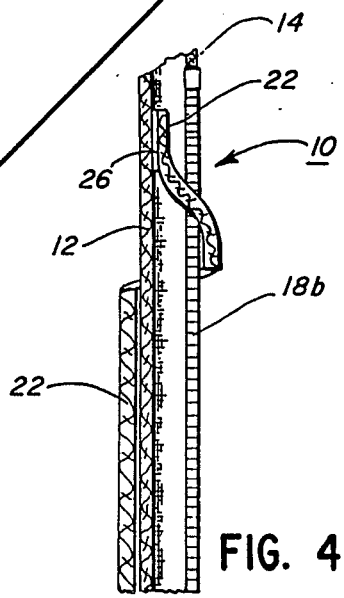
FIG. 4 is a cross-sectional view, taken along the plane of the line 4—4 of FIG. 2.

It can be seen that when the bib is not in use, it is folded and inserted within opening 16, between the front ply 12 and rear ply 14. The zipper is closed, as illustrated in FIG. 3, so that the tie will be worn as an ordinary necktie without any requirement for a separate soil prevention means to be carried by the wearer. When the wearer desires to eat and prevent the necktie from becoming soiled, zipper 20 is unzipped and bib 22 is unfolded and removed via opening 16. A portion of necktie 10 is then extended through slot 28 of bib 22 so that bib 22 will overlie the portion of the necktie, as illustrated in FIGS. 1 and 2.

Although an illustrative embodiment of the invention has been shown and described, it is to be understood that various modifications and substitutions may be made by those skilled in the art without departing from the novel spirit and scope of the present invention.

What is claimed is:

1. A necktie comprising a folded member having a front ply and a rear ply, said rear ply defining an opening along the back of the necktie;

an attached bib that is attached to the necktie inside of the opening and adapted to be folded and positioned within said opening between said front ply and sair rear ply;

said bib defining a slot adjacent to but below the point of attachment of said bib to the necktie; said slot being at least as wide as a width of the necktie for enabling a portion of the necktie to pass through the slot when said bib is unfolded and removed via said opening from between said front ply and said rear ply.

2. A necktie as described in claim 1, including means for closing said opening when said bib is folded and within said opening.

3. A necktie as described in claim 2, said closing means comprising a zipper.

4. A necktie as described in claim 1, said opening being in the longitudinal direction of said necktie.

5. A method for preventing a necktie from becoming soiled, including the steps of:

providing a necktie having a front ply and a rear ply, with the rear ply defining an opening;

providing a foldable bib attached to the inside of the necktie, the bib defining a slot therein, said bib being positioned within said opening between said front ply and said rear ply;

unfolding said bib and removing it via said opening from between said front ply and said rear ply; and thereafter extending a portion of said necktie through said bib slot so that said bib overlies said necktie portion.

* * * * *